US005739628A

United States Patent [19]

Takada

[11] Patent Number: 5,739,628

[45] Date of Patent: Apr. 14, 1998

[54] FIELD EMISSION TYPE COLD CATHODE DEVICE WITH CONICAL EMITTER ELECTRODE AND METHOD FOR FABRICATING THE SAME

[75] Inventor: Naruaki Takada, Tokyo, Japan

[73] Assignee: NEC Corporation, Tokyo, Japan

[21] Appl. No.: 654,735

[22] Filed: May 29, 1996

[30] Foreign Application Priority Data

May 31, 1995 [JP] Japan ..... 7-133703

[51] Int. Cl.[6] ..... H01J 17/36

[52] U.S. Cl. ..... 313/309; 313/336; 313/351; 313/497; 313/310

[58] Field of Search ..... 313/309, 336, 313/351, 308, 495, 497, 310

[56] References Cited

U.S. PATENT DOCUMENTS 5,162,704 11/1992 Kobori et al. ..... 313/336 X
5,394,006 2/1995 Liu ..... 313/336 X

FOREIGN PATENT DOCUMENTS 1-149351 6/1989 Japan .
4-274123 9/1992 Japan .
5-151887 6/1993 Japan .
6-52788 2/1994 Japan .

OTHER PUBLICATIONS

C. Miller, "Surface Flashover of Insulators", IEEE Translations on Electrical Insulation, vol. 24, No. 5, pp. 765–786, Oct. 1989.

C.A. Spindt et al., "Physical properties of thin-film field emission cathodes with molybdenum cones", *Journal of Applied Physics*, vol. 47, No. 12, Dec. 1976, pp. 5248–5263.

*Primary Examiner*—Ashok Patel
*Attorney, Agent, or Firm*—Young & Thompson

[57] ABSTRACT

A field emission type cold cathode device has a substrate whose upper surface is conductive, an insulating layer deposited on the conductive surface, a conductive gate layer, and a conical emitter electrode having a sharp apex formed in an opening in the insulating layer and the gate electrode. The insulating layer includes a first insulating film and a second insulating film. The insulating layer in the opening has an exposed surface arranged so that electrons emitted from near an end portion of the first insulating film are kept away from exposed surfaces of the insulating layer. In one form, the exposed surface of the first insulating film is disposed at a level lower than an unexposed surface of the first insulating film thus forming a recess. In another form, the second insulating film exposed in the opening is recessed relative to the first insulating film exposed in the opening.

14 Claims, 8 Drawing Sheets

FIELD EMISSION TYPE COLD CATHODE DEVICE WITH CONICAL EMITTER ELECTRODE AND METHOD FOR FABRICATING THE SAME

BACKGROUND OF THE INVENTION (1) Field of the invention

The present invention relates to an electron emission device, and more particularly to the structure of a field emission type cold cathode with improved insulating characteristics, and a method for fabricating the same.

(2) Description of the Related Art

Conventionally, hot cathode type electron emission devices have been used widely. Electron emission using a hot cathode has, however, suffered from problems such as large power consumption due to heating. In order to solve these problems, several cold cathode type electron emission devices have been developed. An example of such devices is an electron emission device of a field emission type which locally generates a high electric field for emitting electrons.

In a field emission type cold cathode device, a high electric field (2 to $5\times10^7$V/cm) is generated near the tip of an electrode having a sharp edge to emit electrons into space. Therefore, the sharpness of the electrode apex influences the electron emission characteristics, and a radius of curvature less than several hundreds of Angstroms is generally required. For the generation of the electric field, the apex of the electrode is disposed close to the gate electrode with a gap of 1 μm or less, and a voltage of several tens to several hundreds of volts is applied to the gate electrode. Several thousand to several ten thousand unit elements having the above structure are often connected in parallel to form an array, which is fabricated by using semiconductor fine processing techniques.

One of typical methods of fabricating such a field emission type cold cathode is a method developed by C. A. Spindt et al. of Stanford Research Institute (SRI) of U.S.A. (journal of Applied Physics, Vol. 47, No. 12, pp. 5248–5263, December 1976). With this method, refractory metal such as molybdenum is deposited on a conductive substrate to form a structure having a sharp edge. This method is illustrated in FIGS. 1A to 1D. As shown in FIG. 1A, a silicon oxide film 42 is formed on a silicon substrate 41 and thereafter molybdenum is deposited by vacuum evaporation to form a gate layer 44 (gate electrode). Photoresist 46 is coated and patterned by photolithography. Next, as shown in FIG. 1B, by using the photoresist pattern as a mask, the gate layer 44 and silicon oxide film 42 are etched to form an opening 47 having a diameter of about 1 μm. Thereafter, the photoresist pattern is removed. Next, as shown in FIG. 1C, an aluminum sacrificial layer 48 is deposited by oblique spin evaporation in a vacuum evaporation system, and molybdenum is vertically deposited to form an emitter electrode 45. At this time, a molybdenum layer 40 is also deposited on the aluminum sacrificial layer 48. Next, as shown in FIG. 1D, the aluminum sacrificial layer 48 is selectively etched to lift off the molybdenum layer 40. With a unit element formed as described above, a negative voltage is applied to the emitter electrode 45 and a positive voltage is applied to the gate layer (gate electrode) 44 so that an electric field is concentrated near the apex of the emitter electrode 45 and 50 that electrons are emitted from the apex in the direction perpendicular to the surface of the silicon substrate 41. This structure is generally called a vertical type field emission cold cathode.

In addition to the cross sectional structure of the device described above, the following structures and fabrication methods are known. In Japanese Patent Application Kokai Publication No. Hei 4-274123, as shown in FIGS. 2A to 2D, a rectangular opening is formed in insulating layers 52, 53, and 55 formed on a single crystal silicon substrate 51 having a <111> direction (FIG. 2B). Single crystal aluminum is selectively grown in a vapor phase, starting from the exposed surface 56 of the single crystal silicon substrate 51 in the opening (FIG. 2B). This vapor phase growth of single crystal aluminum utilizes the feature that single crystal aluminum grows fast in a <100> direction and slow in the <111> direction. This publication teaches that an emitter electrode 57 having an apex with a sharp edge can be formed. If high frequency power is applied in the course of the vapor phase growth, amorphous aluminum starts growing on the insulating layer on which there had been no growth thereof. A collector electrode 58 is therefore formed on the upper insulating layer 55, and single crystal aluminum further grows on the emitter electrode 57 (FIG. 2D).

In Japanese Patent Application Kokai Publication No. Hei 1-149881, as shown in FIGS. 3A to 3D, a rectangular opening is formed in an insulating layer 62 formed on a single crystal silicon substrate 61 having a <100> direction (FIG. 3A). Single crystal silicon is selectively grown in a vapor phase, starting from the exposed surface 66 of the single crystal silicon substrate 61 in the opening (FIG. 3B). This vapor phase growth of single crystal silicon utilizes the aspect that single crystal silicone grows fastest in the <100> direction and at different growth rates respectively in other directions. This publication teaches that an emitter electrode 67 having an apex of a sharp edge can be formed while forming crystal facets of higher orders. This vapor phase growth uses a high temperature of 1030° C. Therefore, an upper insulating film 65 and a gate electrode 64 are formed after the emitter electrode 67 is formed (FIGS. 3C and 3D).

In Japanese Patent Application Kokai Publication No. Hei 6-52788, as shown in FIGS. 4A to 4E, by using a silicon oxide film 72 as a mask (FIG. 4A), a silicon substrate 71 is isotropically etched to form a conical projection as a basis of an emitter electrode 77 on the surface of the silicon substrate 71 (FIG. 4B). Next, the surface of the silicon substrate 71 is thermally oxidized (FIG. 4C). Thereafter, in order to reinforce an insulating function, a silicon insulation auxiliary layer 75 is deposited, and then molybdenum is deposited to form a gate electrode 74 (FIG. 4D). Next, the silicon oxide layers 72 and 73 are etched so as to lift off silicon and molybdenum on the emitter electrode 77. At the same time, the apex of the emitter electrode 77 made of the silicon substrate 71 is exposed so that a distance between the emitter electrode 77 and the gate electrode 74 is reduced (FIG. 4E).

In Japanese Patent Application Kokai Publication No. Hei 5-151887, as shown in FIGS. 5A to 5E, an element with a hole of a large diameter is formed without slanting a wafer. First, three layers including a first metal film 81, an insulating film 82, and a second metal film 84 are formed on a glass substrate 80 in this order. Next, photo-resist 89 is coated on the second metal layer 84 and, by photolithography, a fine hole 86 is formed in the second metal film 84. Next, the insulating film 82 is half-etched through the hole 86 (FIG. 5A). The insulating film 82 immediately under the hole 86 is removed so as to form a trench 88 exposing the first metal film 81 (FIG. 5B). Next, while the glass substrate 80 is maintained horizontally, nickel 90 is deposited on the second metal film 84 and on the trench 88 (FIG. 5C). Next, molybdenum 91 is vertically deposited through the hole 86 to form an emitter electrode 87 on the nickel 90 buried in the trench 88 (FIG. 5D). Lastly, nickel 90 on the second metal film 84 is etched to lift off the molybdenum 91 thereon (FIG. 5E).

A field emission type cold cathode device has a very short distance of 1 μm or less between electrodes across which a voltage of several tens of volts or higher is applied as described above. Therefore, the performance of the device depends greatly upon the insulating characteristics between the electrodes, such as dielectric breakdown strength and the leakage current. Specifically, if the dielectric breakdown voltage is low, an element may be broken and be fatally damaged before an electric field reaches a point where sufficient electrons are emitted from the emitter electrode. If the leakage current is large, power consumption increases or the large leakage current hinders a stable operation of the element. A field emission type cold cathode device is often used an array with a number of the elements being connected in parallel. However, if even one element is broken for some reason with one element forming a short-circuit, the whole device becomes inoperable. Therefore, in order to improve yield and product quality and maintain them at this level, not only is it required that the dielectric breakdown voltage be made high, but it is also required that, broken element readily be open-circuited, and that the breakdown not propagate to other elements.

Dielectric breakdown strength is classified into three types: 1) a breakdown voltage determined by the insulating layer between the substrate and the gate electrode; 2) a breakdown voltage determined by a length between the side surfaces of the hole formed in the insulating layer; and 3) a voltage to start the discharge between the emitter electrode and the gate electrode. The breakdown voltage under 2) in particular becomes also a cause of the discharge under 3). That is, creeping discharge occurs starting from a triple-junction formed by the side wall of the insulating layer in the hole and the substrate, or even if the creeping discharge does not occur, the vacuum is locally lowered so that discharge between the emitter and the gate electrodes is triggered. A general mechanism of creeping discharge will be described. Electrons emitted from the substrate by a strong electric field collide with the wall of the insulating layer near the triple-junction. This impact energy causes secondary electrons to be emitted from the wall of the insulating layer, and the secondary electrons collide with an upper wall of the insulating layer to emit further secondary electrons. This cycle is repeated and secondary electrons are increased to eventually result in discharge breakdown (IEEE Trans. Electr. Insl. Vol. 24, pp. 765-786, 1989).

The problems in conventional techniques will be described in detail with reference to the above cited prior art examples. In the structure proposed by Spindt et al. shown in FIGS. 1A to 1D, the side wall of the silicon oxide film 42 extends from the silicon substrate 41 and directly couples to the gate electrode 44. Electrons emitted out of the silicon substrate 41 near the triple-junction are move upward by the electric field. Therefore, there are certain probabilities that electrons will collide with the tapered side wall of the silicon oxide film 42. Since secondary electrons are emitted, creeping discharge occurs or the vacuum is lowered by local heating by electron collision to trigger a discharge between the emitter electrode 45 and the gate electrode 44. Although the insulation characteristics are somewhat improved by the tapered side wall of the silicon oxide film 42, this prior art proposal is not a sufficient solution to the problem.

The prior art shown in FIGS. 2A to 2D has the disadvantage of not allowing fabrication flexibility because of various constraints, such as; the silicon substrate 51 has the <111> direction, the bottom surface pattern of the emitter electrode 57 is required to be rectangular because a single crystal surrounded by particular facets is grown by selective epitaxy, the emitter electrode 57 is made of aluminum, etc. When selectively growing single crystal aluminum at a vapor phase, crystal does not actually grow into contact with the insulating layer 52 as shown in FIG. 2D, but rather a gap is formed between the insulating layer 52 and single crystal aluminum, resulting in a very unstable structure. Furthermore, when high frequency power is applied in the course of the vapor phase growth to grow amorphous aluminum on the upper insulating layer 55 to form the collector electrode 58, amorphous aluminum is formed at the same time on the side walls of the upper and lower insulating layers 55 and 53, thus short-circuiting all the emitter, gate, and collector electrodes 57, 54, and 58. Accordingly, this prior art proposal poses a problem that a desired element cannot be formed practically.

The prior art shown in FIGS. 3A to 3D has a disadvantage of not allowing fabrication flexibility because of various constraints such as the silicon substrate 61 has the <100> direction, the bottom surface pattern of the emitter electrode 67 is required to be rectangular, the emitter electrode 67 is made of silicon, the upper insulating layer 65 and the gate electrode 64 are formed after the emitter electrode 67 is formed because the vapor phase growth is performed at a high temperature, etc. Furthermore, since the gate electrode 64 is formed at the last step by photolithography, the emitter electrode 67 may be misaligned. If the distance between the emitter electrode 67 and the gate electrode 64 becomes shorter than a design allowance, electrons emitted from the emitter electrode 67 enter the gate electrode 64, which may likely trigger discharge breakdown. Still further, since single crystal silicon is selectively grown at the vapor phase, the single crystal silicon on the insulating layer 62 forms very irregular gaps at the interface between the insulating layer 62 and the single crystal silicon. Therefore, various crystal directions appear at the interface, resulting in the emitter electrodes 67 with elements having individually different shapes. In addition, strictly speaking, the corners of the rectangular pattern are round and influenced by the patterning process. Since these round portions have various crystal directions, the resulting emitter electrodes 67 will have different shapes on a pattern to pattern basis.

In the prior art shown in FIGS. 4A to 4E, the silicon substrate 71 is processed to form the conical projection to be used for the basis of the emitter electrode 77, and at the last step, the silicon oxide films 72 and 73 are etched to expose the apex of the emitter electrode 77. The distance between the emitter electrode 77 and the gate electrode 74 is shorter than the distance between the two ends of the exposed side surface of the insulating film so that the side surface of the insulating film is directly in contact with the gate electrode 74 and extends from the emitter electrode 77. In addition, since the gate electrode 74 is curved upward, the direction of the electric field generated near the triple-junction at the intersection between the emitter electrode 77 and the side surface of the insulating film is toward the gate electrode 74. Therefore, electrons emitted from the emitter electrode 77 near the triple-junction collide with the side surface of the insulating film, and secondary electrons are emitted therefrom. With the short distance between the emitter electrode 77 and the gate electrode 74 as one of the reasons, the discharge between them is likely to be caused by creeping discharge or by a local low vacuum. The problem in with this structure is that the distance between the emitter electrode 77 and the gate electrode 74 is short and the emitter electrode 77 and the gate electrode 74 are located at an upper area of the element. Thus, when discharge breakdown occurs, short-circuits and discharges are likely to be propagated to adjacent elements.

The prior art shown in FIGS. 5A to 5E has a structure combining the structure shown in FIGS. 1A to 1D and the structure of forming the emitter electrode by processing the silicon substrate shown in FIGS. 4A to 4E. The side wall of the insulating film 82 extends from the emitter electrode 87 and directly couples to the gate electrode 84. Near the triple-junction at the intersection between the emitter electrode 87 and the insulating film 82, the electric field is in the direction perpendicular to the side wall of the emitter electrode 87. Therefore, electrons emitted from the emitter electrode 87 collide with the side wall of the insulating film 82, and secondary electrons are emitted from the side wall. These secondary electrons trigger a discharge between the emitter electrode 87 and gate electrode 84 because of a creeping discharge or a local low vacuum, and degrade the insulation characteristics. With this structure, once a discharge breakdown occurs, short-circuits and discharges are likely to be propagated to adjacent elements, as explained above.

SUMMARY OF THE INVENTION

It is an object of the present invention, therefore, to overcome the problems existing in the prior art and to provide an multi-element structure having excellent insulation characteristics in which the influence of a single element breakdown can be minimized so that the structure will not be fatally damaged.

According to one aspect of the invention, there is provided a field emission type cold cathode device comprising:

a gate electrode layer;

first and second insulating layers, which are disposed between the gate electrode layer and a substrate whose upper surface is conductive, an opening which is defined by the insulating layers and the gate electrode;

an emitter electrode which is disposed in the opening, and which has a generally conical shape with a sharp apex, the first insulating film in the opening having an exposed surface opened in a directed such that electrons emitted from the emitter electrode near an end portion of the first insulating film are kept away from a surface of the insulating layer.

In the structure of the field emission type cold cathode device of this invention constructed as above, the periphery of the skirt of the emitter electrode reliably rides on the first insulating layer, the conductor side (emitter electrode) of the triple-junction is perpendicular to the surface of the substrate and the insulator side (first insulating layer) of the triple-junction is parallel to the surface of the substrate. A discharge is triggered by a creeping discharge or by a local low vacuum in the following way. Electrons emitted from the conductor side by an electric field collide with the surface of the insulator and secondary electrons are consecutively generated. Therefore, local heating occurs and a low vacuum is generated by separation of adsorptive substances. In order to realize a method of suppressing emission of secondary electrons from the insulator side, it is therefore important to adopt a structure in which electrons emitted from the conductor side are unlikely to collide with the surface of the insulator side. As described above, in the characteristic structure of the field emission type cold cathode device according to the invention, the conductor side (emitter electrode) rises upright relative to the substrate, the insulator side (first insulating layer) is formed horizontally. With this characteristic structure, electrons emitted from the emitter electrode near the triple-junction by a concentrated electric field are forced to move upward by the upward electric field and will not collide with the surface of the horizontal first insulating layer. Accordingly, secondary electrons are not emitted from the surface of the first insulating layer and discharge is not triggered, thereby increasing the dielectric breakdown voltage considerably and maintaining high yield and product quality.

An important point in the structure is that the surface of the insulating film constituting the triple-junction is open faced, with the open face having an enlarged angle with respect to the electric field so that electrons emitted from the conductor side are prevented from colliding with the surface of the insulating film.

BRIEF DESCRIPTION OF THE DRAWINGS

The above and other objects, features and advantages of the present invention will be apparent from the following description of preferred embodiments of the invention explained with reference to the accompanying drawings, in which.

PREFERRED EMBODIMENTS OF THE INVENTION

Now, preferred embodiments of the invention will be described with reference to the accompanying drawings.

Figure 1A:
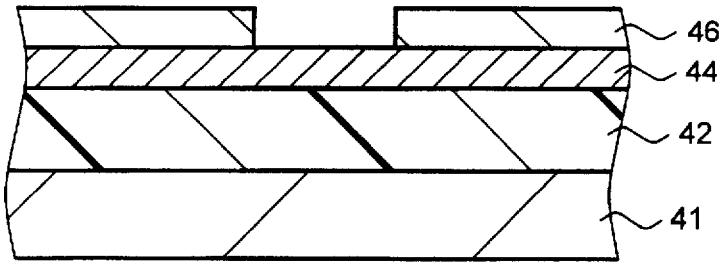
Fig. 1A PRIOR ART
FIGS. 1A to 1D are cross sectional views illustrating processes of a fabrication method for a main element of a conventional typical field emission type cold cathode device.
Figure 1B:
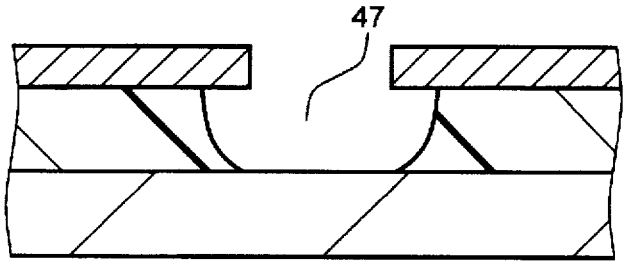
Fig. 1B PRIOR ART
Figure 1C:
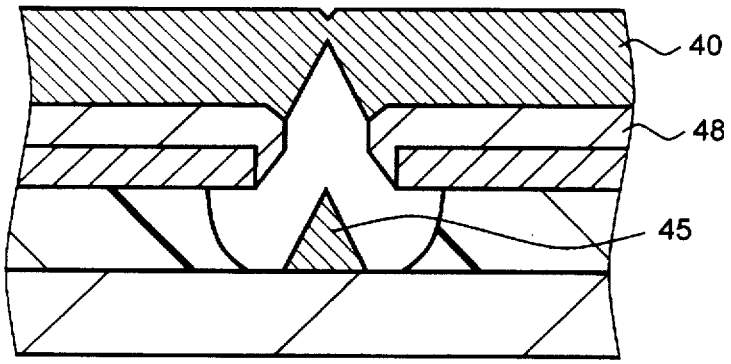
Fig. 1C PRIOR ART
Figure 1D:
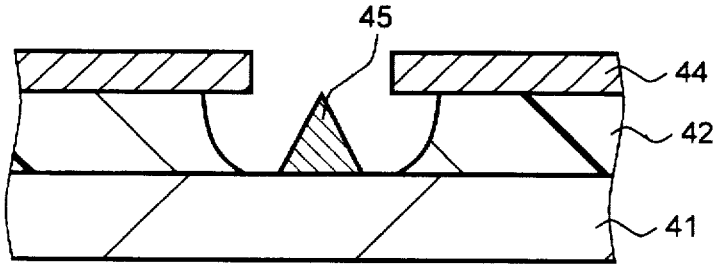
Fig. 1D PRIOR ART
Figure 2A:
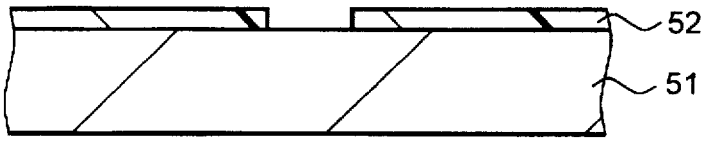
Fig. 2A PRIOR ART
FIGS. 2A to 2D are cross sectional views illustrating a fabrication method for a field emission type cold cathode device according to a prior art of Japanese Patent Application Kokai Publication No. Hei 4-274123.
Figure 2B:
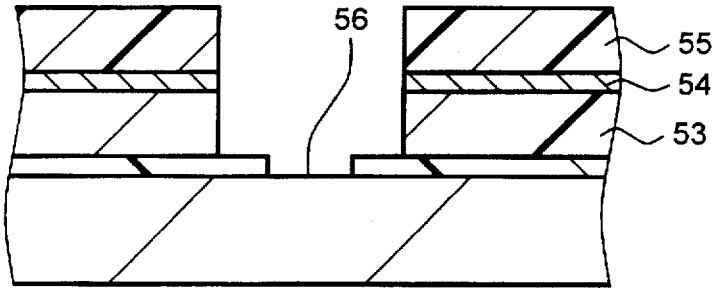
Fig. 2B PRIOR ART
Figure 2C:
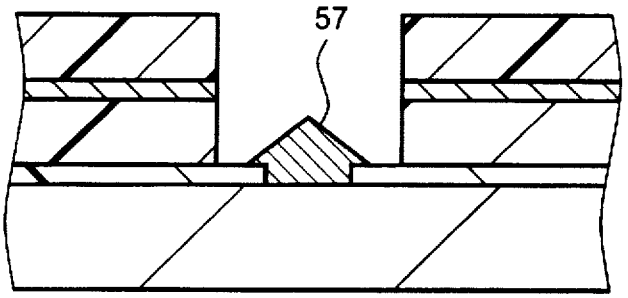
Fig. 2C PRIOR ART
Figure 2D:
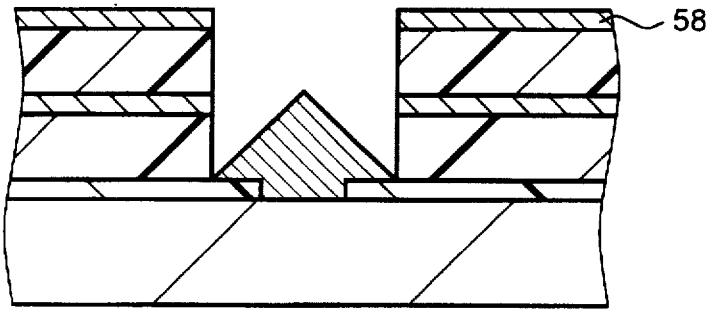
Fig. 2D PRIOR ART
Figure 3A:
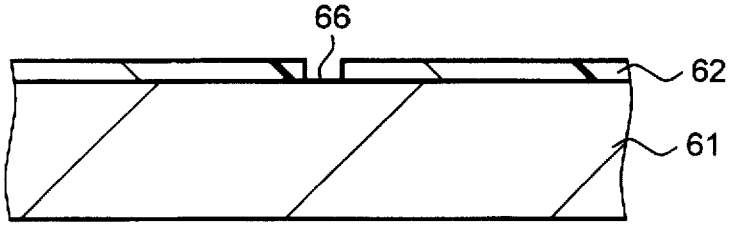
Fig. 3A PRIOR ART
FIGS. 3A to 3D are cross sectional views illustrating a fabrication method for a field emission type cold cathode device according to a prior art of Japanese Patent Application Kokai Publication No. Hei 1-149351.
Figure 3B:
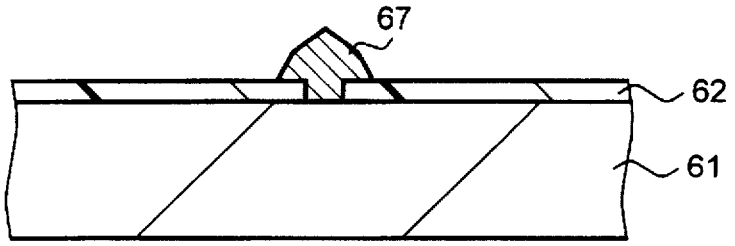
Fig. 3B PRIOR ART
Figure 3C:
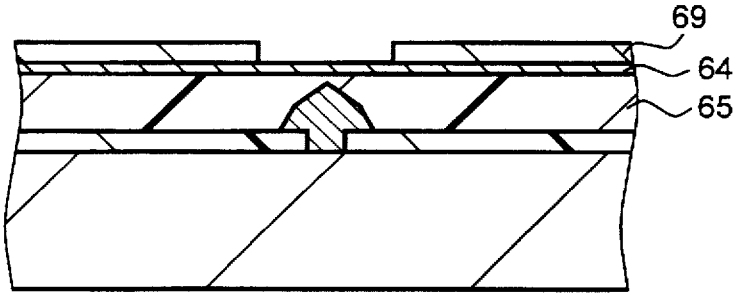
Fig. 3C PRIOR ART
Figure 3D:
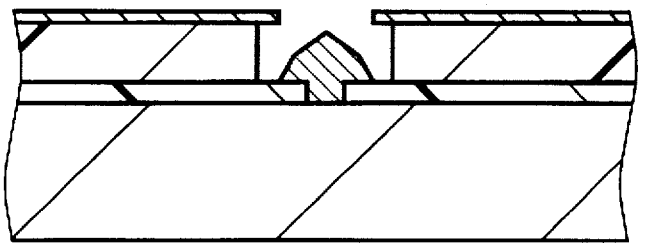
Fig. 3D PRIOR ART
Figure 4A:
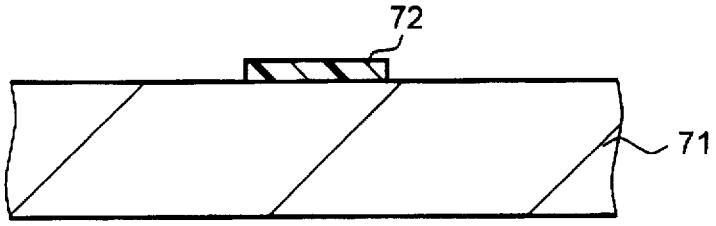
Fig. 4A PRIOR ART
FIGS. 4A to 4E are cross sectional views illustrating a fabrication method for a field emission type cold cathode device according to a prior art of Japanese Patent Application Kokai Publication No. Hei 6-52788.
Figure 4B:
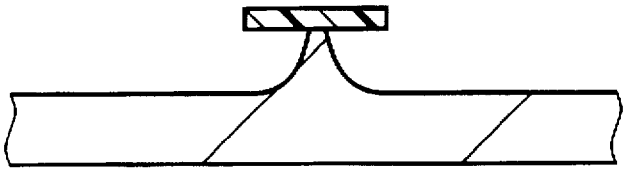
Fig. 4B PRIOR ART
Figure 4C:
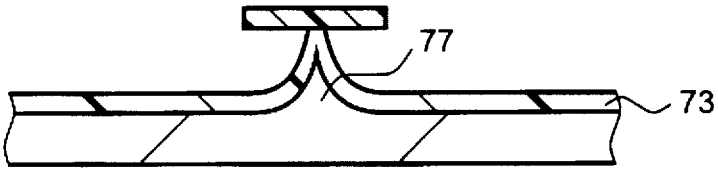
Fig. 4C PRIOR ART
Figure 4D:
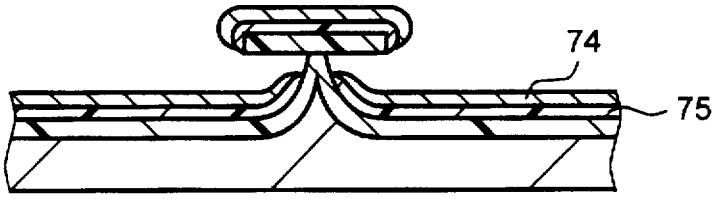
Fig. 4D PRIOR ART
Figure 4E:
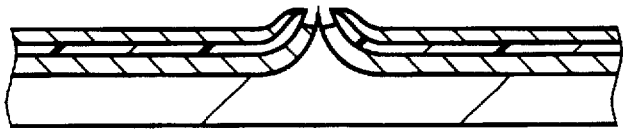
Fig. 4E PRIOR ART
Figure 5A:
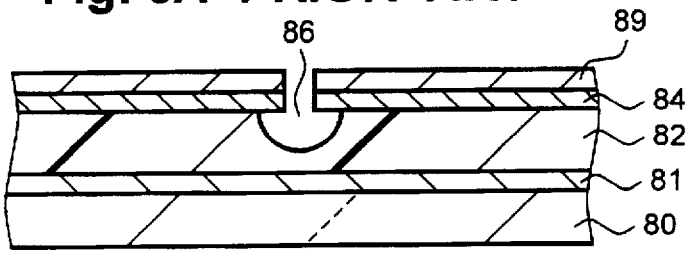
Fig. 5A PRIOR ART
FIGS. 5A to 5E are cross sectional views illustrating a fabrication method for a field emission type cold cathode device according to a prior art of Japanese Patent Application Kokai Publication No. Hei 5-151887.
Figure 5B:
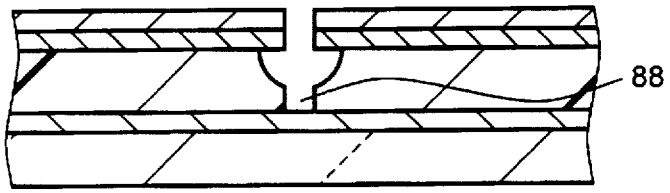
Fig. 5B PRIOR ART
Figure 5C:
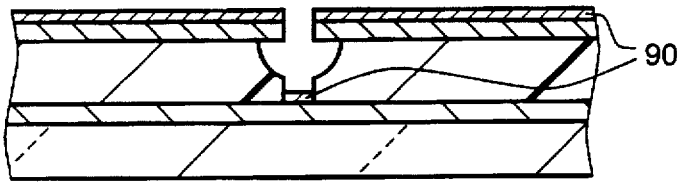
Fig. 5C PRIOR ART
Figure 5D:
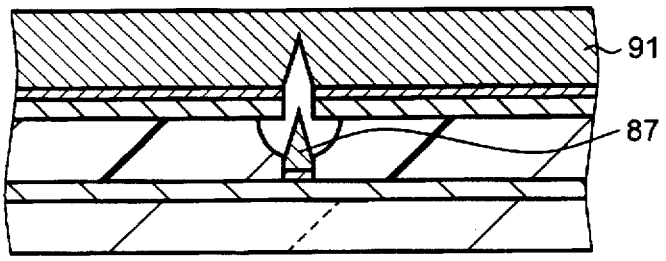
Fig. 5D PRIOR ART
Figure 5E:
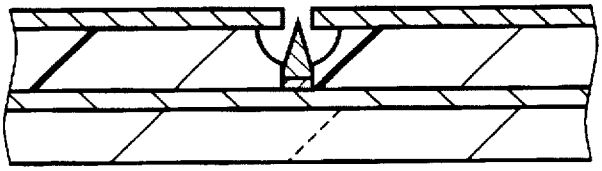
Fig. 5E PRIOR ART
Figure 6:
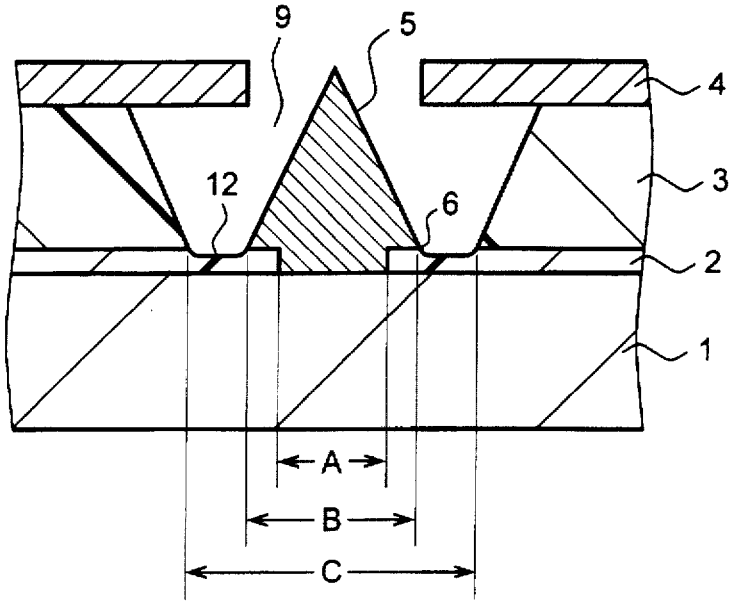
FIG. 6 is a cross sectional view of a main element of a field emission type cold cathode device according to a first embodiment of the invention.
Figure 7:
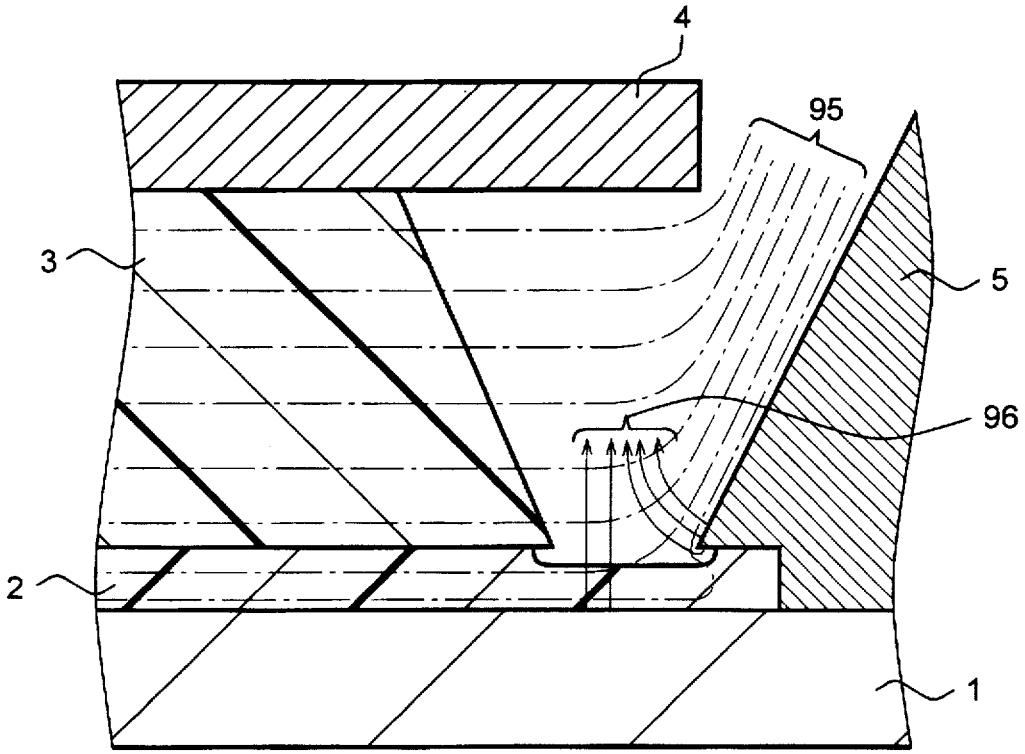
FIG. 7 is a cross sectional view showing an equipotential surface and an electric field direction of a main element of a field emission type cold cathode device of this invention.

FIG. 6 is for, explaining a first embodiment of the invention. In the structure of this embodiment, a first insulating layer 2 having an opening with a diameter "A" is formed on a substrate 1, made of semiconductor or formed with a metal layer on the surface thereof. A conical emitter electrode 5 rising upright relative to the substrate 1 buries the opening in the first insulating layer 2 and has a skirt portion which rides on the upper surface of the first insulating layer 2. this skirt portion having a bottom diameter "B" larger khan the diameter "A". A second insulating layer 3 has an opening with a diameter "C" larger than the diameter "B" of the skirt portion of the conical emitter electrode 5. The surface of the first insulating layer 2 exposed between the emitter electrode 5 and second insulating layer 3 is lower than the surface of the unexposed first insulating layer 2. In other words, since the emitter electrode 5 rises upright relative to the substrate 1 and the first insulating layer 2 is horizontal, even if electrons are emitted from the emitter electrode 5 near a triple-junction 6 because of the concentrated electric field, these electrons move upward under the influence of the upward electric field shown in FIG. 7 and are unlikely to collide with the first insulating layer 2. This is because the surface of the first insulating layer 2 that constitutes the triple-junction 6 is open faced such that the surface is directed perpendicular to the direction of the electric field near the triple-junction 6 and that the electrons are kept away from the surface. Therefore, secondary electrons are not emitted from the first insulating layer 2 and discharge or the like is not triggered by a creeping discharge or a local low vacuum caused by heat. For example, as compared to the structure of the Spindt type shown in FIGS. 1A to 1D which has a dielectric breakdown voltage of about 70 V, the structure of this invention improved the dielectric breakdown voltage about 150 V.

Figure 8A:
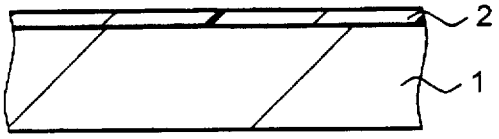
FIGS. 8A to 8G are cross sectional views illustrating a method for fabricating a main element of a field emission type cold cathode device according to a second embodiment of the invention.
Figure 8B:
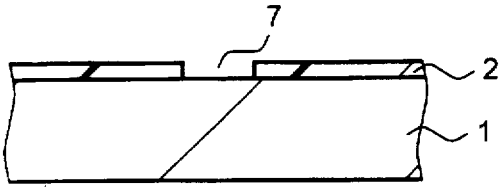
Figure 8C:
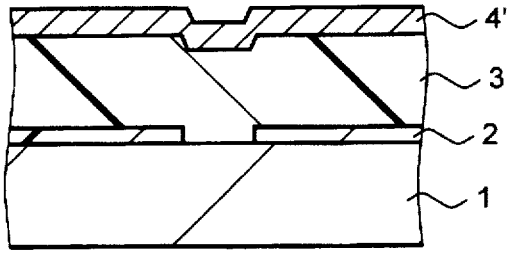

Next, a method for fabricating a main element of a field emission type cold cathode device according to the second embodiment of the inventions will be described with reference to FIGS. 8A to 8G. FIGS. 8A to 8G are cross sectional views illustrating the main processes of forming a field emission type cold cathode device of this invention. First, as shown in FIG. 8A, on the surface of an N -type silicon substrate 1, a first insulating layer 2 is formed to a thickness of 800 Angstroms by vapor phase growth or by thermal oxidation. Next, as shown in FIG. 8B, an opening 7 having a diameter of about 0.7 μm is formed in the first insulating layer 2 by photolithography. Next, as shown in FIG. 8C, on the surface of the first insulating layer 2 and on the surface of the N-type silicon substrate 1 exposed in the opening 7, a second insulating layer 3 is formed by vapor phase growth. Further, on the surface of the second insulating layer 3, a conductive film 4' is formed by vapor phase growth, vacuum evaporation, or sputtering. The material of this conductive film 4' is metal such as molybdenum, tungsten, and tungsten silicide, impurity doped polysilicon.

Figure 8D:
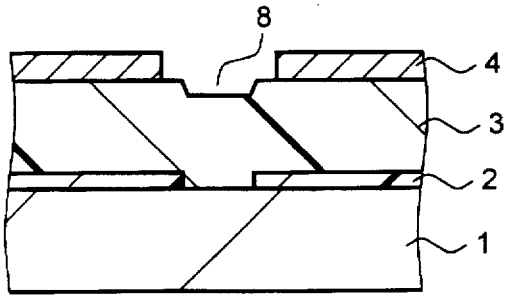
Figure 8E:
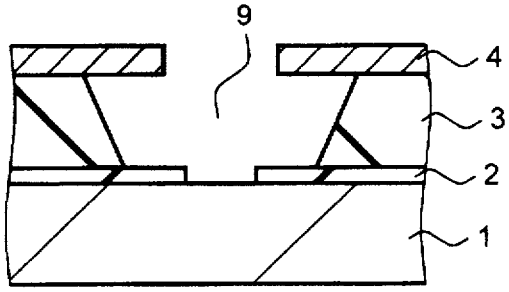

Next, as shown in FIG. 8D, an opening 8 with a diameter of about 1.0 μm is formed in the conductive film 4' by photolithography to form a gate electrode 4. Next, as shown in FIG. 8E, an opening 9 is formed in the second insulating layer 3, by using the conductive film 4' or the mask material (e.g., photoresist) used for forming the gate electrode 4 as a mask. For this etching, the material of the first insulating layer 2 is selected to have an etching selectivity greater than that for the material of the second insulating layer 3. For example, if the material of the first insulating layer 2 is silicon nitride and the second insulating layer 3 is silicon oxide, a desired opening shape can be obtained by etching with hydrofluoric acid. Etching is performed for a sufficient time after the surface of the N-type silicon substrate 1 under the opening 7 in the first insulating layer 2 is exposed, so that the side wall of the second insulating layer 3 is etched. Therefore, the opening 9 can be formed which has a diameter larger than the opening 7 in the first insulating film 2 and the opening 8 in the gate electrode 4. For example, with proper etching times being set, the opening 9 can be formed having a diameter of about 1.2 μm which is larger than the diameter 0.7 μm of the opening 7 in the first insulating layer 2 and the diameter 1.0 μm of the opening 8 in the gate electrode 4. If the silicon nitride film is formed directly on the surface of the N-type silicon substrate 1, the exposed surface of the N-type silicon substrate is contaminated and made irregular when the opening 7 is formed by etching (e.g., dry etching with tetrafluorocarbon). Therefore, the first insulating layer 2 may be formed by forming a thin silicon oxide film (about 300 Angstroms) on the N-type silicon substrate 1 by thermal oxidation and thereafter by depositing silicon nitride by vapor phase growth.

Figure 8F:
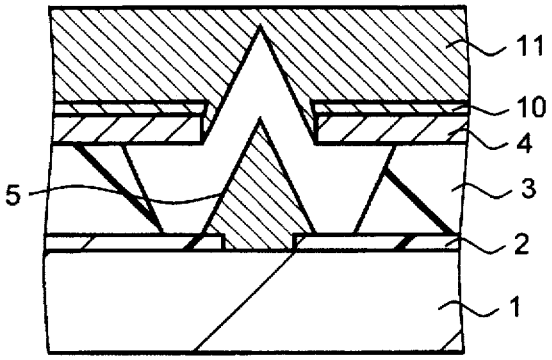
Figure 8G:
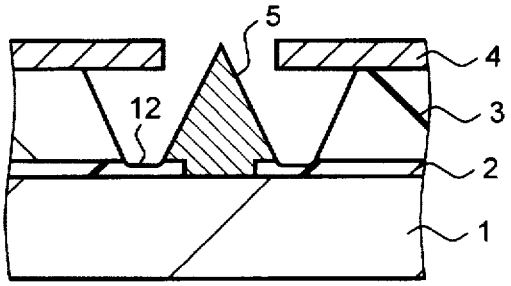

Next, as shown in FIG. 8F, a sacrificial layer 10 is deposited by oblique spin evaporation in a vacuum evaporation system, and refractory metal is vertically deposited to form an emitter electrode 5. At this time, a refractory metal layer 11 is deposited on the sacrificial layer 10. Next, as shown in FIG. 8G, the sacrificial layer 10 is selectively etched to lift off the refractory metal layer 11. The material of the sacrificial layer may be aluminum, alumina, and the like, and the material of the refractory metal may be tungsten, nickel, molybdenum, and the like. Thereafter, a recess 12 is formed on the surface of the exposed first insulting layer 2 by isotropic etching. If the first insulating layer 2 is made of silicon nitride, this isotropic etching may use phosphoric acid based chemical or tetrafluorocarbon gas.

With the method for fabricating a field emission type cold cathode device of this invention, the gate electrode opening 8, second insulating layer opening 9, and conical emitter electrode 5 can be formed in self-alignment by one photolithography process used when the gate electrode is formed. Therefore, the position where the opening 9 contacts the first insulating layer 2 and the position where the outer periphery of the skirt portion of the emitter electrode 5 rides on the first insulating layer 2 can be set with high precision.

The advantages of the field emission type cold cathode device of this invention over the previously described prior art examples will be briefly described. In the prior art by Spindt et al. shown in FIGS. 1A to 1D, the side wall of the insulator (silicon oxide film) extends from the conductor (silicon substrate) and directly couples to the conductor (gate electrode). With this structure, electrons emitted from the conductor (silicon substrate) near the triple-junction fly along the electric field direction and are likely to collide with the side wall of the insulator (silicon oxide film).

In the prior art examples shown in FIGS. 4A to 4E and 5A to 5E, the side wall of the insulator (insulating film) extends from the conductor (emitter electrode) and directly couples to the conductor (gate electrode), and the electric field direction near the triple-junction is toward the side wall of the insulator (insulating film). With this structure, electrons emitted from the conductor (emitter electrode) are very likely to collide with the side wall of the insulator (insulating film).

The field emission type cold cathode device of this invention has eliminated the disadvantages of the above prior art structures by providing the structure shown in FIG. 6. Specifically, the conductor (emitter electrode 5) rises upright relative to the substrate, the insulator (first insulating layer 2) is formed horizontally, and the recess 12 is formed in the insulator (first insulating layer 2). With this characteristic structure, electrons emitted from the conductor (emitter electrode 5) near the triple-junction by the concentrated electric field are forced to move upward by the upward electric field and will not collide with the surface of the horizontal insulator (first insulating layer 2). Accordingly, secondary electrons are not emitted from the surface of the insulator (first insulating layer 2) and discharge will not be triggered, thereby improving the dielectric breakdown strength considerably and maintaining high yield and product quality. An important point in the structure is that the open face is formed in the insulator (first insulating layer 2) constituting the triple-junction, so that electrons emitted from the conductor (emitter electrode 5) will not collide with the surface of the insulator (first insulating layer 2). Even if discharge occurs and an element is broken, the scale of breakdown is small because the first insulating layer 2 covers the substrate 1, and discharge breakdown will not propagate to adjacent elements.

The prior art fabrication methods illustrated in FIGS. 2A to 2D and 3A to 3D, selectively grow single crystal on the silicon substrate at a vapor phase as described earlier. Therefore, absorption of atoms into the surface of the insulating layer for growing single crystal is suppressed, and gaps are formed unavoidably between the insulating layer and single crystals, thereby exposing a part of the insulating layer and being unable to realize the structure of this invention. Accordingly, the bottom of the emitter electrode adheres only to the small surface area of the silicon substrate exposed in the opening in the insulating layer and this structure is obviously unstable and quite different from the field emission type cold cathode of this invention.

The prior art example illustrated in FIGS. 2A to 2D also suffers a problem of being unable to form an element of a field emission type cold cathode because of short-circuits of the emitter, gate, and collector electrodes caused by amorphous aluminum grown on the side walls of the upper and lower insulating layers upon application of high frequency power in the course of the vapor phase growth. Such short-circuits will not occur in the case of the fabrication method of this invention which provides a field emission type cold cathode device having good breakdown voltage characteristics.

In the prior art illustrated in FIGS. 3A to 3D, after the emitter electrode is formed, the gate electrode is formed by photolithography. Therefore, the gate and emitter electrodes may be misaligned. The distances between emitter and gate electrodes may differ in different fabrication lots. In addition, the distances to the right and left side ends of the gate electrode may also differ so that the threshold level of electron emission varies resulting in unstable performance. With the fabrication method for a field emission type cold cathode device of this invention, since the gate and emitter electrodes are formed in self-alignment, there is no positional misalignment.

Figure 9A:
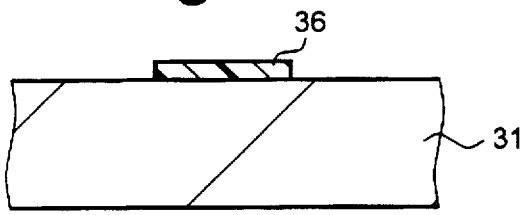
FIGS. 9A to 9G are cross sectional views illustrating a method for fabricating a main element of a field emission type cold cathode device according to a third embodiment of the invention.
Figure 9B:
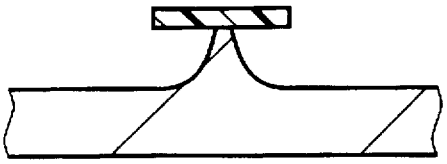
Figure 9C:
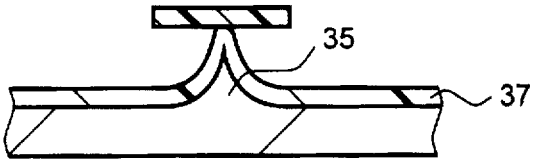
Figure 9D:
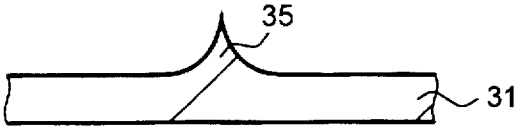
Figure 9E:
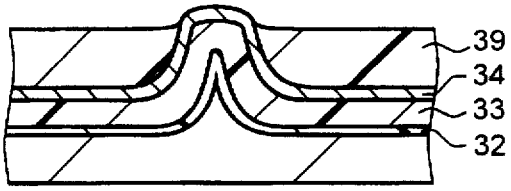

Next, the fabrication method for a main element according to the third embodiment of this invention is illustrated in the cross sectional views of FIGS. 9A to 9G. A surface of the silicon substrate 31 is etched using a silicon nitride film 36 as a mask (FIGS. 9A and 9B). The resulting structure is thermally oxidized to form a silicon oxide film 37 (FIG. 9C). The silicon nitride film 36 and the silicon oxide film 37 are removed whereby an exposed emitter electrode structure is formed (FIG. 9D). Next, a first insulating film 32, a second insulating film 33, a gate electrode 34, and a coat film 39 are sequentially formed (FIG. 9E). For example, a silicon nitride film is formed as the first insulating film 32 and a silicon oxide film is formed as the second insulating film 33, respectively by vapor phase growth. A polysilicon film is formed as the gate electrode 34. Lastly, an oxide based film is formed by a coater as the coat film 39, thin at the projection area and thick at the recessed portion. The coat film is hardened by heat treatment at about 400° C.

Figure 9F:
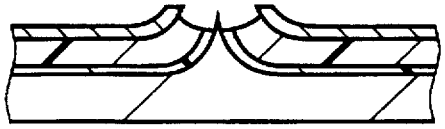
Figure 9G:
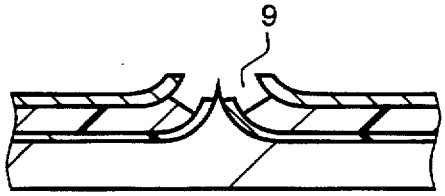

Next, the layered structure is dry-etched from the upper surface so that the projected polysilicon 34 is etched to the tip portion of the emitter electrode 35. Then, the silicon oxide film 33 is etched with hydrofluoric acid based chemical until the surface of the silicon nitride film 32 at the projection portion is exposed. At this time, the coat film 39 is also etched and removed. Next, the silicon nitride film 32 is etched with phosphoric acid based chemical to expose the tip of the emitter electrode 35 (FIG. 9F). Next, the silicon oxide film 33 is again etched with hydrofluoric acid based chemical to retract the exposed silicon oxide film 33 (FIG. 9G). The features of this embodiment reside in the following. After the emitter electrode 35 is formed, the first and second insulating layers 32 and 33 and the gate electrode 34 are formed. Thereafter, the tip of the emitter electrode 35 is exposed by etching. Therefore, since the exposed area is small, a possibility of attachment of dusts and stains and adsorption of adsorptive substances during fabrication processes can be suppressed to low.

In this embodiment of the invention, the silicon nitride film 32 is made as thin as about 300 Angstroms, to suppress as much as possible the influence of electron collision near the triple-junction between the emitter electrode 35 and silicon nitride film 32. In the structure of the element, therefore, the silicon nitride film 32 is formed in parallel with the side wall of the emitter electrode 35. With this structure, electrons emitted from the emitter electrode 35 near the triple-junction are forced to move in the direction perpendicular to the side wall of the emitter electrode 35 by the electric field vertical to the side wall, and will not collide with the surface of the silicon nitride film 32. This embodiment provides a finer field emission type cold cathode device by using the silicon substrate itself as the emitter electrode.

As described above, in the structure of the field emission type cold cathode device of this invention, an open face is formed in the insulator constituting a triple-junction in the electric field direction, so that there is no likelihood of electrons emitted from the conductor constituting the triple-junction collidins with the surface of the insulator. Accordingly, secondary electrons will not be emitted from the surface of the insulator and discharge will not be triggered, thereby increasing the dielectric breakdown strength considerably. Even if an element is broken by discharge, the conductor and the gate electrode do not form a short-circuit and a problem may only be open-circuit damage because the insulating film covers the conductor. As a result, breakdown of one element does not influence the whole device. With these effects, the invention can provide a field emission type cold cathode device retaining high yield and product quality.

While the invention has been described in its preferred embodiments, it is to be understood that the words which have been used are words of description rather than limitation and that changes within the purview of the appended claims may be made without departing from the true scope of the invention as defined by the claims.

What is claimed is:

1. A field emission cold cathode device comprising:

a substrate with a conductive upper surface;

a first insulating layer on said upper surface;

a second insulating layer on said first insulating layer;

a gate electrode on said second insulating layer;

an opening extending through said gate electrode and said first and second insulating layers;

an emitter electrode in said opening, wherein said emitter electrode has a generally conical shape with a sharp upwardly extended apex, is separated from said gate electrode and said second insulating layer, is in electrical contact with said upper surface, and has a lower periphery contacting said first insulating layer adjacent said opening; and means for impeding electrons emitted from said lower periphery of said emitter electrode from reaching surfaces of said first and second insulating layers exposed in said opening, wherein said means for impeding comprises said surface of said first insulating layer exposed in said opening which is recessed relative to a surface of said first insulating layer which is not exposed in said opening.

2. The device of claim 1, wherein said recessed surface is generally perpendicular to an axis of said conically shaped emitter electrode.

3. The device of claim 2, wherein said surface of said second insulating layer exposed in said opening is obliquely angled away from said recessed surface of said first insulating layer.

4. The device of claim 1, wherein said emitter electrode comprises a refractory metal.

5. A field emission cold cathode device comprising:

a substrate with a conductive upper surface;

a first insulating layer on said upper surface;

a second insulating layer on said first insulating layer;

a gate electrode on said second insulating layer;

an opening extending through said gate electrode and said first and second insulating layers;

an emitter electrode in said opening, wherein said emitter electrode has a generally conical shape with a sharp upwardly extended apex, is separated from said gate electrode and said second insulating layer, is in electrical contact with said upper surface, and has a lower periphery contacting said first insulating layer adjacent said opening; and means for impending electrons emitted from said lower periphery of said emitter electrode from reaching surfaces of said first and second insulating layers exposed in said opening, wherein said means for impeding comprises said surface of said second insulating layer exposed in said opening which is recessed relative to said surface of said first insulating layer which is exposed in said opening.

6. The device of claim 5, wherein said surface of said first insulating layer exposed in said opening is an edge of said first insulating layer formed by said opening which is generally perpendicular to an axis of said conically shaped emitter electrode.

7. The device of claim 6, wherein said surface of said second insulating layer exposed in said opening is obliquely angled away from said first insulating layer.

8. A field emission cold cathode device comprising;

a substrate with a conductive upper surface;

a first insulating layer on said upper surface;

a second insulating layer on said first insulating layer;

a gate electrode on said second insulating layer;

an opening extending through Said gate electrode and said first and second insulating layers;

an emitter electrode in said opening, wherein said emitter electrode has a generally conical shape with a sharp upwardly extended apex, is separated from said gate electrode and said second insulating layer, is in electrical contact with said upper surface, and has a skirt with a lower face contacting said first insulating layer adjacent an edge thereof formed by said opening; and said first insulating layer having a surface exposed in said opening which is recessed relative to a surface of said first insulating layer which is not exposed in said opening for impeding electrons emitted from said skirt of said emitter electrode from reaching surfaces of said first and second insulating layers exposed in said opening.

9. The device of claim 8, wherein said recessed surface is generally perpendicular to an axis of said conically shaped emitter electrode.

10. The device of claim 8, wherein said surface of said second insulating layer exposed in said opening is obliquely angled away from said recessed surface of said first insulating layer.

11. The device of claim 8, wherein said emitter electrode comprises a refractory metal.

12. A field emission cold cathode device comprising:

a substrate with a conductive upper surface;

a first insulating layer on said upper surface;

a second insulating layer on said first insulating layer;

a gate electrode on said second insulating layer;

an opening extending through said gate electrode and said first and second insulating layers;

an emitter electrode in said opening, wherein said emitter electrode has a generally conical shape with a sharp upwardly extended apex, is separated from said gate electrode and said second insulating layer, is an upwardly extended part of said upper surface, and has a periphery contacting said first insulating layer adjacent said opening; and said second insulating layer having a surface exposed in said opening which is recessed relative to a surface of said first insulating layer which is exposed in said opening for impeding electrons emitted from said lower periphery of said emitter electrode from reaching surfaces of said first and second insulating layers exposed in said opening.

13. The device of claim 12, wherein said surface of said first insulating layer exposed in said opening is an edge of said first insulating layer formed by said opening which is generally perpendicular to an axis of said conically shaped emitter electrode.

14. The device of claim 12, wherein said surface of said second insulating layer exposed in said opening is an edge of said second insulating layer formed by said opening which is angled away from said first insulating layer.

* * * * *